US011202523B2

(12) United States Patent
Chivrac et al.

(10) Patent No.: US 11,202,523 B2
(45) **Date of Patent: *Dec. 21, 2021**

(54) CONTAINER FOR FOOD PRODUCT HAVING A MANUALLY OPERABLE ACTUATING MEMBER

(71) Applicant: COMPAGNIE GERVAIS DANONE, Paris (FR)

(72) Inventors: Frederic Chivrac, Paris (FR); Pedro Galera Sanchez, Ibi (ES)

(73) Assignee: COMPAGNIE GERVAIS DANONE, Paris (FR)

( * ) Notice: Subject to any disclaimer, the term of this patent is extended or adjusted under 35 U.S.C. 154(b) by 389 days.

This patent is subject to a terminal disclaimer.

(21) Appl. No.: 15/531,297

(22) PCT Filed: Nov. 27, 2014

(86) PCT No.: PCT/IB2014/002736

§ 371 (c)(1),
(2) Date: May 26, 2017

(87) PCT Pub. No.: WO2016/083860

PCT Pub. Date: Jun. 2, 2016

(65) Prior Publication Data

US 2017/0340150 A1 Nov. 30, 2017

(51) Int. Cl.
*B65D 83/00* (2006.01)
*B65D 1/32* (2006.01)
(Continued)

(52) U.S. Cl.
CPC ..... *A47G 19/32* (2013.01); *B65D 1/32* (2013.01); *B65D 21/0233* (2013.01);
(Continued)

(58) Field of Classification Search
CPC ..... A47G 19/32; B65D 1/32; B65D 85/76; B65D 83/0055; B65D 21/0233;
(Continued)

(56) References Cited

U.S. PATENT DOCUMENTS 4,724,982 A * 2/1988 Redmond ..... B65D 75/367 222/94
5,511,684 A * 4/1996 Weaver, Jr. ..... B65D 25/20 206/505
(Continued)

FOREIGN PATENT DOCUMENTS

CH 473719 A * 6/1969 ..... B65D 1/32
DE 20 2011 001219 U1 4/2011
(Continued)

OTHER PUBLICATIONS

International Search Report, dated Jul. 27, 2015, from corresponding PCT application.

*Primary Examiner* — Viren A Thakur
(74) *Attorney, Agent, or Firm* — Nixon & Vanderhye

(57) ABSTRACT

The container for a molded food product is provided with a hollow body including a bottom wall and a side wall extending from the bottom wall to a wide end provided with a discharge opening. The bottom wall has an outer edge extending around a longitudinal axis of the container and a venting device manually operable to define one or more vent holes in the bottom wall. The venting device includes a push member provided with an actuation portion and at least one first hinge adjacent to the actuation portion. The push member is longitudinally movable between an initial proximal position, in which the vent holes are closed by corresponding closing members, and a predetermined distal position, in which the vent holes are open.

18 Claims, 7 Drawing Sheets

(51) Int. Cl.

| | |
|---|---|
| ***B65D 25/38*** | (2006.01) |
| ***A47G 19/32*** | (2006.01) |
| ***B65D 21/02*** | (2006.01) |
| ***B65D 85/76*** | (2006.01) |
| *B65D 85/72* | (2006.01) |

(52) U.S. Cl.
CPC ..... *B65D 25/38* (2013.01); *B65D 83/0005* (2013.01); *B65D 83/0055* (2013.01); *B65D 85/76* (2013.01); *B65D 85/72* (2013.01); *B65D 2231/027* (2013.01)

(58) Field of Classification Search
CPC ..... B65D 25/38; B65D 83/0005; B65D 2231/027; B65D 85/72
See application file for complete search history.

(56) References Cited

U.S. PATENT DOCUMENTS

| | | | | |
|---|---|---|---|---|
| 2012/0258210 | A1* | 10/2012 | Wong ..... | A47J 31/3695 426/115 |
| 2014/0130678 | A1* | 5/2014 | Frydman ..... | A47J 31/407 99/295 |

FOREIGN PATENT DOCUMENTS

| | | | | |
|---|---|---|---|---|
| EP | 0426506 | A1 * | 5/1991 | ..... B65D 1/32 |
| EP | 0734971 | A1 * | 10/1996 | ..... B29C 51/04 |
| EP | 1 354 809 | A1 | 10/2003 | |
| EP | 2 722 284 | A1 | 4/2014 | |
| FR | 2226846 | A * | 12/1974 | |
| WO | WO-2004009457 | A1 * | 1/2004 | ..... B65D 1/32 |
| WO | 2006/051383 | A1 | 5/2006 | |

* cited by examiner

CONTAINER FOR FOOD PRODUCT HAVING A MANUALLY OPERABLE ACTUATING MEMBER

BACKGROUND OF THE INVENTION

Field of the Invention

The present invention generally relates to containers used in food packaging industry, particularly to thermoformed plastic containers, such as pots or cups for firm products, preferably dairy firm products, for instance creams or custard-like products which have been set, thus having a certain consistency and defining a molded product.

For example, the container may be a cup-like plastic container comprising: a bottom wall, a side wall tightly connected to the bottom wall, so as to define an interior volume of the container, an opening (discharge opening) at the opposite from the bottom wall, wherein the bottom wall comprises an outer edge and a venting device manually operable to define at least one vent hole at said bottom wall.

Description of Related Art

A container of the type mentioned above eliminates use of a spoon or other implement for removing the food content. For example, EP 1 354 809 A1 discloses such a container provided with a depressible vent seal tab for releasing food content through the opening. When air enters the container through the vent hole, air pressure and the force due to gravity (by overcoming the friction force between the food product and the side wall of the container) force the food content of the container to start moving downward toward the opening.

For injection molded containers, a line of weakness is produced around a pin by decreasing the thickness of a wall. But this cannot be applied to the manufacture of containers by thermoforming a plastic sheet, because in this case, crushing or rolling the sheet to form a zone or a line of reduced thickness results in obtaining a flexible hinge, and not by that of a line of weakening or rupture.

Moreover, for some molded food products, the user often has to wait almost one minute for the release. Additionally, the bubble of air formed by air entry often causes deformation of the food mass and performing this release from the container through the wide mouth presents certain manipulative difficulties (and the shape of semi solid or solid food can be spoiled).

SUMMARY OF THE INVENTION

The purpose of the present invention is to provide a container efficient for releasing a mass of food product without spoiling its shape while at the same time having a user friendly and quick actuation to obtain such efficiency.

To this end, embodiments of the present invention provide a cup-like container for a molded food product, comprising:

- a single bottom wall;
- a side wall tightly connected to the bottom wall, so as to define an interior volume of the container from the bottom wall;
- an opening at the opposite from the bottom wall;

wherein the bottom wall comprises:

- an outer edge extending around a longitudinal axis of the container; and
- a venting device manually operable to define at least one vent hole in said bottom wall;

and wherein the venting device comprises a push member that comprises:

- an actuation portion, preferably extending at a distance from the outer edge, and
- at least one first hinge adjacent to the actuation portion, wherein the push member is longitudinally movable between an initial proximal position, in which said vent hole is closed, and a predetermined distal position, in which said vent hole is open.

The fact that one or more vent holes are formed in the bottom by simply pushing a movable part of the bottom wall is advantageous because containers may be manufactured by thermoforming a plastic sheet. More generally, there is a greater simplicity to obtain the bottom wall of the container, without use of an additional layer or any other operation with a cutting tool or the like.

The push member may be displaced in a longitudinal direction, which is useful to guide movement of the food product (natural push gesture for the user) and risk of deforming the molded mass is minimized by inappropriate air displacement in the interior volume. With such arrangement, the time sufficient for the sliding may decrease, even if the product is viscous. The term "longitudinally" should be understood in an extensive manner regarding movement of the push member, not necessarily strictly parallel to the longitudinal axis but following the same general direction. Preferably, at least two spaced vent holes, and more preferably three spaced vent holes may be defined in the distal position of the push member.

According to a particular feature, the vent holes are each radially distant from the longitudinal axis X and typically extend between an actuation portion of the push member and the outer edge. Such laterally shifted position if advantageous, in order to obtain accurate opening when a plurality of the vent holes are provided. Indeed, actuation of the opening may be obtained by the single push member and the size of the vent holes may partly defined by a peripheral part, around the deformable part defined by the push member.

In various embodiments of the container of the invention, recourse may optionally also be had to one or more of the following dispositions:

- the bottom wall comprises a peripheral part, extending around the push member and comprising the outer edge, and at least one second hinge at an annular junction between the push member and the peripheral part (with such configuration with an outer hinge, the actuation portion may be displaced without a strong pushing and without deformation near the side wall).
- the peripheral part comprises at least one bearing member to define an annular bearing surface, the push member extending at a radial distance from the bearing surface and being preferably intersected by the longitudinal axis (accidental contact with the deformable part of the bottom wall can be prevented when having a bearing member in the peripheral part, while the actuation portion extends interiorly entirely within the limits defined by this bearing member).
- at least one cavity is defined between the second hinge and the side wall, the cavity being part of the interior volume (in such configuration, the second hinge is longitudinally shifted from the outer edge of the bottom wall and a longer displacement is obtained for the actuation portion when the actuation portion extends, in the proximal position, at an intermediate level between the annular bearing surface and the second hinge).
- the interior volume is undivided from the bottom wall to the opening and filled only with a food content molded as one block (with such arrangement and as the side wall typically does not include retaining relief, remaining food in the container is minimized after the release through the opening). Of course, the food content may also include two or more layers to define such block.

the outer edge extends at a free end of the container, around an annular groove defined between the outer edge and the actuation portion.

at least two spaced frangible connections extend in the groove, from the first hinge. The groove is typically a narrow groove having a maximal width inferior to 15 mm (the frangible connections, not parallel to the bearing annular surface, are thus connections that cannot be entirely (unfortunately) covered by a finger, such configuration being of interest to efficiently increase air pressure by use of a reduced number of vent holes).

the push member is configured to break each of the frangible connections and form at least two of the vent holes when the push member is displaced from the proximal position to the distal position.

the actuation portion is configured as a push button in the bottom wall and the bottom wall has a dome shape in the distal position of the push member.

in the distal position, the actuation portion defines an apex of the dome, while the one or several vent holes are provided in a tapered annular wall part of the dome.

the push member comprises a plurality of closing members defined as rigid tabs or tips extending from the actuation portion. This configuration is useful to avoid use of cutting tool to define specific frangible connections. When the rigid protrusions simultaneously follow the direction of pushing, intermediary wall parts are retained by the peripheral part and rotate around the second hinge, such difference in displacement causing a tearing at the thinner junctions defined around a protruding part of the rigid closing members.

the vent holes are initially closed by closing members that are fixed relative to the outer edge and extending from the outer edge to an end, preferably tapered, adjacent to the push member, the closing members defining rigid protrusions in the distal position of the push member. This other configuration is also useful to avoid use of cutting tool to define frangible connections.

the bottom wall and the side wall are parts of a single-piece hollow plastic body (production at high rate for mass production is thus facilitated with such configuration of the hollow body provided with the efficient venting device).

According to the invention, a method to release a molded food product is provided, using a venting device that forms part of a single compartment container (having a single bottom wall, a side wall and an opening through which the food product is discharged along a longitudinal axis of the container). The method comprises:

providing one or more vent holes that are initially closed in the bottom wall, removing a closing system (which may include a film-like seal membrane for instance) so that the opening can define a discharge opening, placing the container in a vertically reverted position, in which the opening is facing downwardly, and pushing a push member of the venting device, at an actuation portion located in the bottom wall and surrounded by an annular outer edge of the bottom wall, so that the push member is displaced longitudinally in a same direction as effect of gravity, wherein the pushing at the actuation portion and use of at least one first hinge adjacent to the actuation portion cause a longitudinal displacement of the push member with a predetermined deformation of the bottom wall, so that the push member is longitudinally displaced through said pushing between an initial proximal position, in which said vent hole is closed, and a predetermined distal position, in which said vent hole is open, whereby the molded food product received in the single compartment defined by the container is replaced by air entering through the vent hole and discharged as one single block through the opening.

According to a particular feature, the pushing is performed at an actuation portion which is surrounded by one or more intermediary wall parts annularly extending between the first hinge and a second hinge of the bottom wall, and wherein the actuation portion is below the second hinge in the predetermined distal position when the opening is facing downwardly, whereby a longitudinal hollow is formed in the molded food product.

After the pushing (and without any additional user action), the molded food product is replaced by air entering inside the container through at least two spaced vent holes that extend between the first hinge and the second hinge.

Other features and advantages of the invention will become apparent to those skilled in the art during the description which will follow, given by way of a non-limiting example, with reference to the appended drawings.

DETAILED DESCRIPTION OF EMBODIMENTS

In the various figures, the same references are used to designate identical or similar elements.

Figure 1:
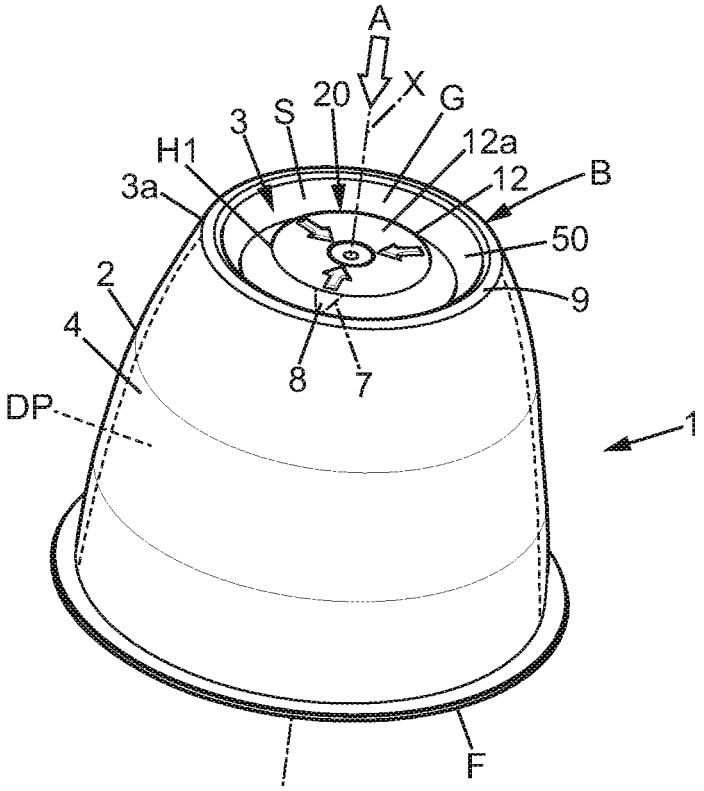
FIG. 1 is a perspective view of a container according to a first embodiment of the invention, in a reverted position adapted for release of the food content.
Figure 2:
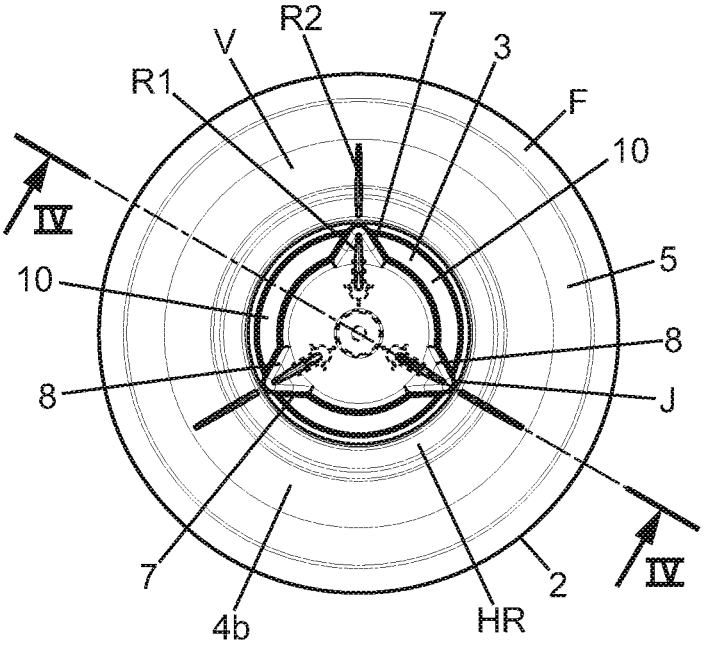
FIG. 2 is a top view of the container of FIG. 1, before filling with food product.

Referring to FIGS. 1-2, the container 1 comprises a hollow body 2 suitable to be filled by food product, typically a solid or semi solid dairy product DP, optionally with an additional layer (topping). Such food product defines a molded mass when received in the container 1 and also when released through an opening 5 (FIG. 2) of the container 1. The dairy product DP or similar product received in the container 1 is typically cooled (for instance stored in a refrigerator) after its production. A seal membrane 5*a* (see FIG. 10) or similar cover seal can typically seal the container 1 after filling with the food product. It is understood that the container 1 is in a reverted position in FIG. 1.

Referring to FIGS. 1-2, 6 and 9, the hollow body 2, 102 comprises a bottom wall 3 and a side wall 4 extending along a longitudinal axis X from the bottom wall 3 to a top 4*a* surrounding the opening 5. The top 4*a* is here defined by a flange F, preferably a planar flange adapted for supporting a cover seal. The side wall 4 is tightly connected to the bottom wall 3, so as to define an interior volume V of the container 1. As apparent in particular in FIGS. 1, 4, 6 and 9, the side wall 4 has an internal surface 4*b* that typically shows a sufficient taper to facilitate release of the product DP which has been molded in the cup-like container 1. The longitudinal axis X may be a central axis, preferably a symmetry axis, for the side wall 4 and the opening 5.

The bottom wall 3 has an outer edge 3*a* and a non-planar exterior surface S. The hollow body 2, 102, is here a thermoplastic body. Optionally, it is obtained from a plastic sheet, preferably a sheet including a mix of PE (polyethylene) and PP (polypropylene), or using similar stretchable material. It is understood that the bottom wall 3 is here defined by a single layer of plastic material and the food product (molded as one block) fills a single compartment defined by the (undivided) interior volume V. Spaced frangible connections 7 or parts ready to be removed (at least partly) are provided in the bottom wall 3. Transparent plastic may be used and a mix PE/PP (for instance with at least 30 wt % for PE, and preferably at least 50 wt %) is particularly suitable to obtain the hollow body 2, 102.

The side wall 4 may be simple and conventional, without recourse to partitioning wall to define an additional compartment. Indeed, here the interior volume may correspond to a single compartment as there is no additional/intermediary bottom. The container 1 is thus of simple shape.

Figure 3A:
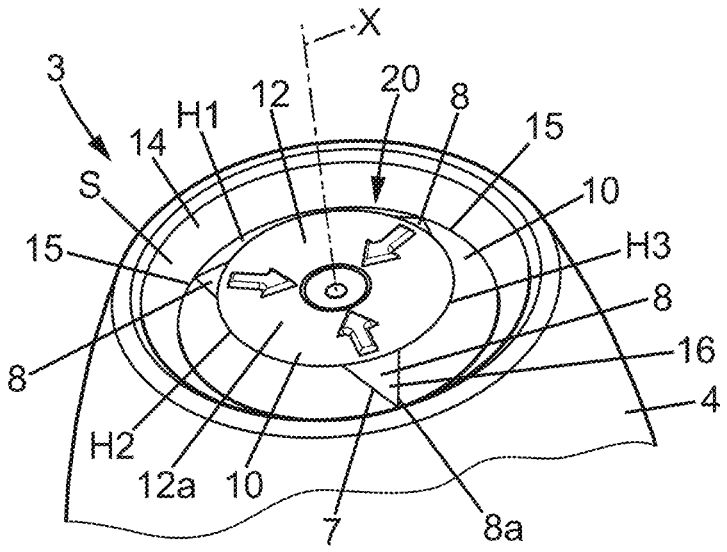
FIG. 3A illustrates the bottom of the container shown in FIG. 1 in a non-actuated state.
Figure 3B:
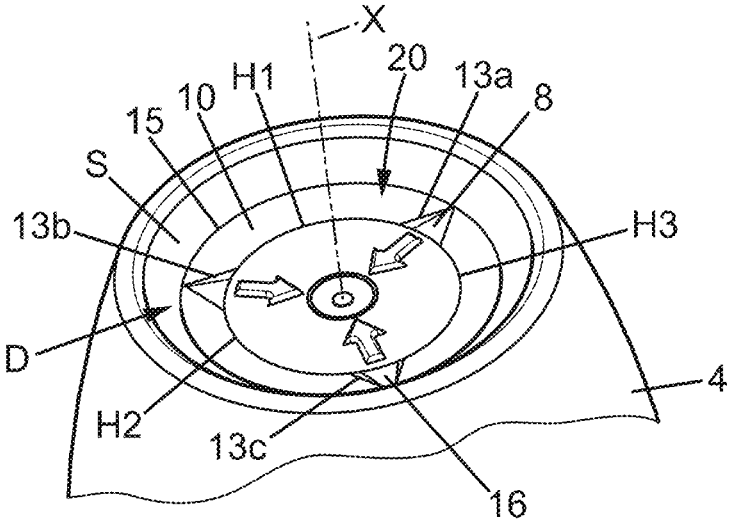
FIG. 3B illustrates the bottom of the container shown in FIG. 1 where the actuating member used to release the food content has been actuated.
Figure 4:
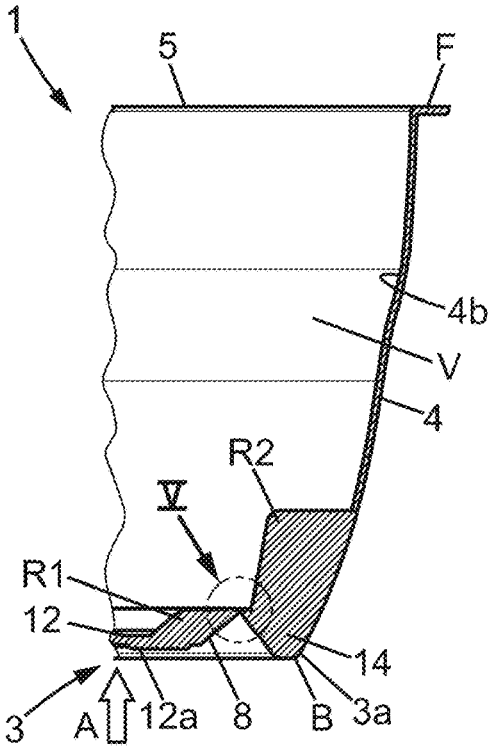
FIG. 4 is an axial cut view showing a part of the bottom provided with a frangible connection.
Figure 5:
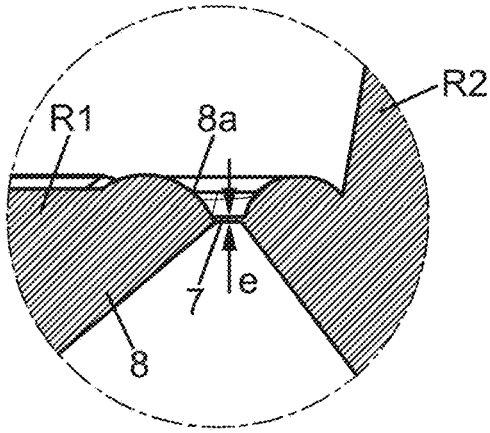
FIG. 5 shows a detail from FIG. 4.

Referring to FIGS. 3A-3B and 4-5, frangible connections 7 are here defined by a local reduction of thickness in the bottom wall 3. The frangible connections 7 are optionally curved or angled. A V-shape may be provided for these frangible connections 7. But other shapes, in particular L-shape, U-shape, C-shape or J-shape may be used. In FIG. 5, it can be seen that the thickness e at the frangible connections 7 may be equal or less than one third as compared to thickness of an actuation portion 12*a* defined centrally in the bottom wall 3. The thickness e may be as low as 0.05 mm for instance.

The bottom wall 3 has a configuration adapted for maintaining the container 1 in a more or less vertical position. Here the outer edge 3*a* is part of an annular bearing member B and extends at a free end of the container 1. Such outer edge 3*a* may have a continuously rounded shape or alternative shapes with corners, preferably rounded corners. The bearing means are optionally chosen amongst a plurality of pegs and an annular lower projection. More generally, the bearing means of the container are integral with one of the bottom wall 3 and the side wall 4. A self standable container 1 is thus formed when the opening 5 is facing upwardly. The bottom wall 3 is less wide than the opening 5.

The bearing means may comprise one ore more protruding bearing members B to prevent contact between wall portions of the bottom wall 3 provided with the frangible connections 7 or similar areas and a horizontal planar surface in contact with the bearing members B. An annular bearing surface 9 (continuous or discontinuous), extending perpendicularly to the longitudinal axis X, is defined by the at least one bearing member B. FIG. 4 shows the higher level of the deformable part of the bottom wall 3 as compared to the bearing member B, in a usual storage position of the container 1.

Figure 6:
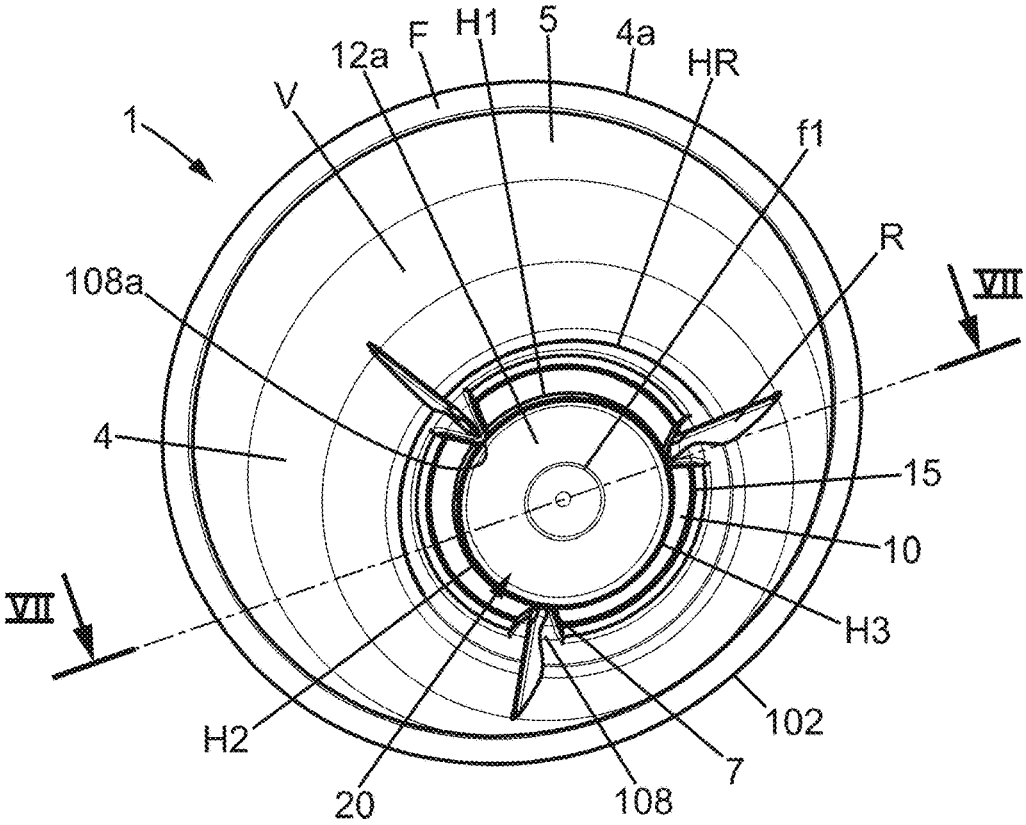
FIG. 6 is perspective view showing a container according to a second embodiment of the invention, before filling with food content.

In a preferred option as shown in FIGS. 2, 3A and 6, the frangible connections 7 extend at opposite short sides of intermediary wall parts 10 that are sloped. It is understood that the frangible connections 7 are here not parallel to the horizontal planar surface in contact with the bearing members B when the container 1 is in a more or less vertical storage position. It can be seen that the frangible connections 7 may be defined between:

a respective one of the intermediary wall parts 10, and a closing member 8, 108.

Here, three frangible connections 7 are provided but their number may be increased or decreased. Each closing member 8, 108 tightly joins two adjacent of the intermediary wall parts 10 at the frangible connections 7 and is configured to interact with the actuation portion 12*a* of a push member 12 (here defining a single actuating member). The actuation portion 12*a* is preferably located centrally in the bottom wall 3 and surrounded by the intermediary wall parts 10, as shown in FIGS. 1-2, 3A-3B and 6. The actuation portion 12*a* may define a substantially flat inner face f1 in direct contact with the food content.

Referring to FIGS. 3A-3B and 6, the push member 12 is movable longitudinally relative to the outer edge 3*a* and is configured to actuate, preferably simultaneously, a relative change of position between the closing members 8, 108 and the plurality of intermediary wall parts 10 of the bottom wall 3. Because of such movement (see also arrow A in FIG. 1) of a deformable part of the bottom wall (3), each of the frangible connections 7 are broken and at least three spaced vent holes 13*a*, 13*b*, 13*c* are formed in the bottom wall 3. As shown in FIGS. 3A-3B, vent holes 13*a*, 13*b*, 13*c* having a generally triangular shape may be obtained because of the break of the frangible connections 7 in respective distinct angular sectors of the bottom wall 3. Such shape is here particularly efficient for obtaining simultaneous opening of relatively wide holes by pushing on a single actuation portion 12*a*. Two adjacent sides of the vent holes 13*a*, 13*b*, 13*c* may each have a length superior or equal to 4 mm in a non-limiting example. It is thus understood that such relatively wide vent holes 13*a*, 13*b*, 13*c* are more efficient than isolated narrow slits for the air entry through the bottom wall 3.

It may be advantageous, in some options, to provide one or more bearing members B (preferably of continuously annular shape) that define an internal recess HR (see FIGS. 2, 6 and 9) to contain a remaining part of the product DP near the side wall 4. Such bearing member or bearing members B are arranged at lower level than the frangible connections 7. After breaking of the frangible connections 7 and release of the product DP, the container 1 may be placed vertically on a support (as in its conventional storage position) with minimized risk of leakage of the remaining food part through the bottom wall 3. The remaining food part that is in contact with the internal surface 4*b* of the side wall 4 can flow toward the internal recess HR and cannot escape through the vent holes 13*a*, 13*b*, 13*c*. Here, these vent holes 13*a*, 13*b*, 13*b* extend radially at a distance from the outer edge 3*a* (i.e. in an inwardly shifted position relative to the peripheral part 14 that comprises the outer edge 3*a* and the bearing member B). Here, the peripheral part 14 may define a continuously annular outer surface 50, not flexible, that extends around a flexible part of the bottom wall 3.

In the non limiting examples of FIGS. 1-3B and 6, it can be seen that the frangible connections 7 or similar movable parts used to define the vent holes 13*a*, 13*b*, 13*c* are distributed to allow formation of distinct air bubbles rather than one single central air bubble. The vent holes 13*a*, 13*b*, 13*c* are preferably each distal from the longitudinal axis X and may be optionally proximal relative to the outer edge 3*a*. At least when the vent holes 13*a*, 13*b*, 13*c* each define an identical or similar section with same spacing relative to the longitudinal axis X, pushing of the dairy product DP (or similar food composition) is performed according to a controlled longitudinal direction and excellent results are obtained for the final shape of the released product. In variants, the vent holes 13*a*, 13*b*, 13*c* may be located differently, not necessarily with a regular spacing.

More generally, the bottom wall 3 of the container 1 is provided with a venting device 20 manually operable to define one or more vent holes 13*a*, 13*b*, 13*c* to allow air to penetrate into the interior volume (through the bottom wall 3). It is understood that a push member 12 is part of this venting device 20 and can form the vent holes 13*a*, 13*b*, 13*c* by displacement from an initial proximal position to a distal position.

Additionally, the push member 12 in the actuated state (distal position) may be conformed as a dome, in order to efficiently push the food content in a centered manner. Such configuration is of interest to guide air toward the side wall 4 (preferably through several vent holes 13*a*, 13*b*, 13*c*) and thus preventing formation of a single air bubble when pushing the push member 12.

Referring to FIGS. 2, 3A and 6, each vent hole 13*a*, 13*b*, 13*c* is closed when the push member 12 is in its initial proximal position. Preferably, the push member 12 is entirely within the limits of the peripheral part 14 and the actuation portion 12*a* extends perpendicularly to the longitudinal axis X, at a distance from the outer edge 3*a*. At least one first hinge H1, H2, H3, which may be a continuous or discontinuous annular hinge, is arranged adjacent to the actuation portion 12*a* to make the bottom wall 3 locally flexible and allow longitudinal movement of the actuation portion 12*a* when pushed from outside. The push member 12 is thus longitudinally movable between the initial proximal position, in which the vent holes 13*a*, 13*b*, 13*c* are closed, and a distal position, in which the vent holes 13*a*, 13*b*, 13*c* are open. The distal position is preferably a predetermined position, in order to prevent any risk of separating the actuation portion 12*a* from the bottom wall 3 (no loss of packaging material).

A specific description of a first embodiment of the invention is now provided with reference to FIGS. 1-5 and 9.

In the first embodiment, the push member is provided with one or more closing members 8 defined as rigid tabs or tips, extending from the actuation portion 12*a* and separating two adjacent hinge portions of the annular hinge H1, H2, H3. A relative displacement occurs between the closing members 8 and the plurality of intermediary wall parts 10 of the bottom wall 3 when the push member 12 is actuated, here pushed parallel to the longitudinal axis X, by a user finger.

Referring to FIG. 2, it can be seen that the plastic push member 12, typically integrally molded with the hollow body 2, (or integrally molded with the bottom wall 3) remains integral with the bottom wall 3 after actuation to create the vent holes 13*a*, 13*b*, 13*c*. Typically, the actuating member 12 may comprise the same plastic material as a single layer that defines the bottom wall 3.

In the proximal position shown in FIG. 1, it can be seen that the outer face of the bottom wall 3 is provided with an annular groove G that extends (here continuously) between the peripheral part 14 and the actuation portion 12*a* of the push member 12. The annular bottom of such groove G may define a second hinge 15 to facilitate displacement of the actuating member 12. Here, the intermediary wall parts 10 rotate in response to the push on the actuation portion 12*a*. As a result, the annular groove G disappears and a single cavity is defined by the bottom wall 3, as visible in FIG. 3B. The second hinge 15, which is here continuous, may be coaxial with the first hinge H1, H2, H3. The second hinge 15 extends at an annular junction between the push member 12 and the peripheral part 14 (such peripheral part 14 being here a non-deformable part of the bottom wall 3). It can be seen in FIG. 3A that the intermediary wall parts 10 and the closing members 8 all extend between the first hinge H1, H2, H3 and between the second hinge 15 in the proximal position of the push member 12 (before actuation).

The position of the second hinge 15 may remain fixed (the same before and after actuation), while position of the first hinge H1, H2, H3 varies, depending on the position (proximal or distal) of the push member 12. At least one cavity extends between the second hinge 15 and the side wall 4 to define the internal recesses HR, such cavity being part of the interior volume V. It is understood that the push member 12 does not interfere with the internal recesses HR (here defined by a non deformable part of the wall bottom) because only the deformable part of the bottom wall 3 is used and displaced (pushed) for the release of the product DP.

The actuation portion 12*a*, here configured as a push button in the bottom wall 3, may extend parallel to the opening 5 in the distal position of the push member 12. The bottom wall 3 has a dome shape in the actuated position as shown in FIG. 3B, the actuation portion 12*a* defining an apex of the dome D. It can be seen that the vent holes 13*a*, 13*b*, 13*c* are provided in a tapered annular wall part of the dome D in this configuration, at a distance from the outer edge 3*a*. The dome shape is typically like a base of a champagne bottle.

In such non limiting embodiment, the push member 12 is connected to the peripheral part 14 by the hinge 15 (here a continuous plastic hinge) and configured as a cam to rotate the intermediary wall parts 10. As shown in FIGS. 1 and 3A, these intermediary wall parts 10 are sloped as compared to a plane of the bottom wall 3 in the initial configuration. In this position, the bottom wall 3 may be provided with frangible connections 7 that extend in the groove G to intersect the annular hinge 15. Then, in the distal position of the push member 12 as shown in FIG. 3B (after actuation by a pushing action), the intermediary wall parts 10 are sloped inward from the peripheral part 14. There is thus a change of slope for the intermediary wall parts 10, so that the interior volume V is greater in the proximal position of the push member 12 (see FIGS. 1, 3A and 6-7) as compared to the distal position (see FIG. 3B).

Because of the dome shape, the vent holes 13*a*, 13*b*, 13*c* that have just been formed may guide external air radially outwards when such air enters the interior volume V of the container 1. In the actuated state (with the predetermined distal position of the push member 12), the vent holes 13*a*, 13*b*, 13*c* preferably each extend between two adjacent of the intermediary wall parts 10 to guide air toward a periphery of the interior volume V. While the intermediary wall parts 10 here have the same area, it is understood that other geometries may be used to allow deformation of the bottom wall 3 at least around the actuation portion 12*a* without substantial deformation of the peripheral part 14 that include the bearing means.

The movement of the push member 12 is here performed in the general direction of the longitudinal axis X. Referring to FIGS. 3A and 4-5, it is understood that the frangible connections 7 may correspond to a local reduction of thickness in the bottom wall 3 and each separate one of the intermediary wall parts 10 from one of the closing members 8. The hinge 15 is preferably stronger than the frangible connections 7 and configured to limit and stop the stroke of the actuation portion 12*a* of the push member 12. The distal position thus may be a predetermined position. The closing members 8 may be provided with an end 8*a* defined by a corner or relatively sharp angle at the junction with the second hinge 15 to facilitate separation of this end 8*a* from the peripheral part 14. At this junction with a very low radius of curvature, the local thickness is reduced since it corresponds to the thickness e of the frangible connections 7. Tearing of plastic material to create the vent holes 13*a*, 13*b*, 13*c* can begin at this end 8*a* of the closing members 8 when the actuation portion 12*a* starts to be pushed. Thanks to the initial separation at this narrow end 8*a*, less force is required to obtain the opening of the vent holes 13*a*, 13*b*, 13*c*.

Figure 9:
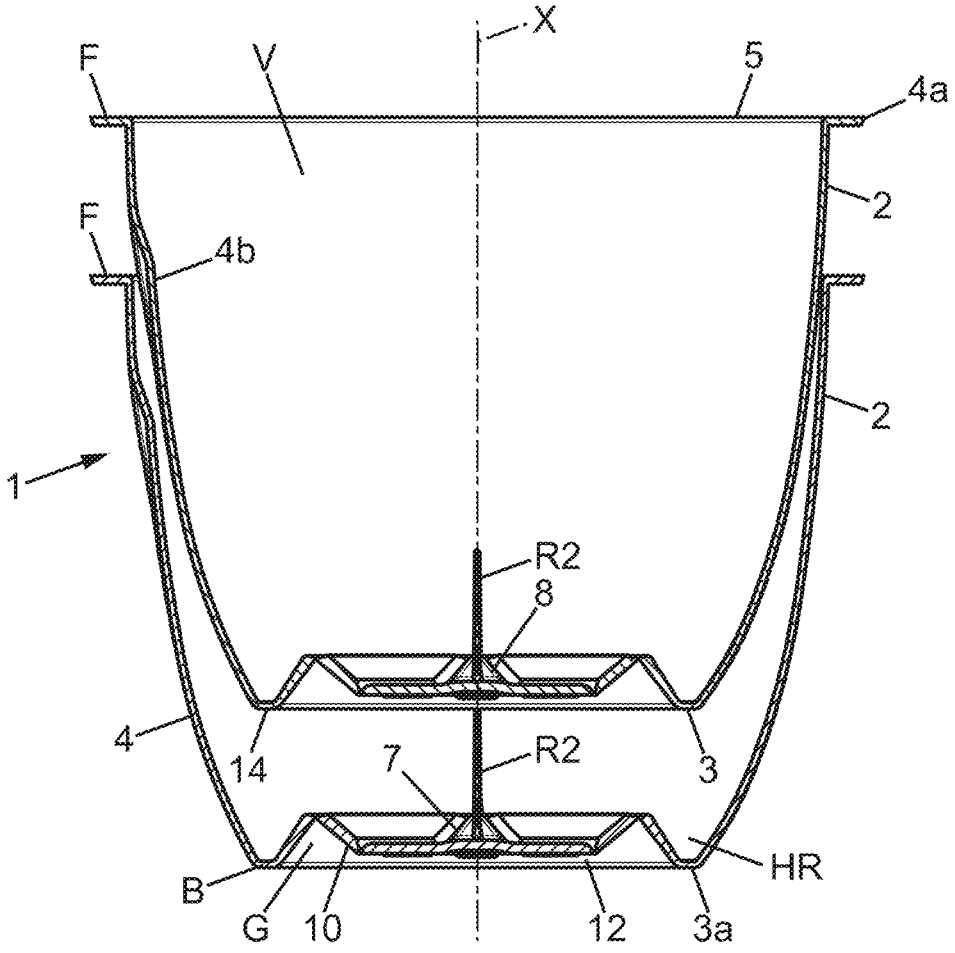
FIG. 9 shows the way two containers are stacked.

Referring to FIGS. 4-5, exact separation between the intermediary wall parts 10 and the closing members 8 is also optionally facilitated, by use of at least one rib R1 on the inner face of the bottom wall 3 to reinforce each of the closing members 8. Other ribs R2 may be provided to reinforce the peripheral part 14, such ribs R2 being useful for stacking of a plurality of containers 1, while maintaining a space between the flanges F of two adjacent containers 1 in the stack. FIG. 9 illustrates the way the containers 1 are stacked. It can be seen that the ribs R2 are preferably higher than the internal recesses HR.

In the first embodiment shown in FIGS. 1-5 and 9, the ribs R1 belong to the push member 12 and thus limit deformation of the push member 12. The bottom wall 3 is here provided with at least three closing members 8 defined as rigid protrusions with respect to the actuation portion 12*a*. In other words, each closing member 8 is a rigid tab or tip radially extending from the actuation portion 12*a* that is at a distance from the ends 8*a*. The closing members 8 follow movement of the actuation portion 12*a*, while the intermediary wall parts 10 rotate by the hinge effect. With such configuration, the dome shape of the bottom wall 3 is obtained in the actuated state for the predetermined distal position, without elements protruding outwardly.

Optionally, each of the frangible connections 7 (typically with a curved or V-shape) is provided with two non parallel portions extending from a common junction J that is part of the hinge 15. The closing member 8 is preferably narrowed at this junction J, so as to define the narrow end 8*a*. For each closing member 8, the rib R1 may extend from the end 8*a* to a part of the inner face f1 (i.e. a region of the actuation portion 12*a* within the perimeter, here a circular perimeter, defined by the outer rim 12*b*). The outer surface 16 of the closing member 8 may be sloped as the intermediary wall parts 10 in the proximal position, as shown in FIG. 3A. Of course, the closing members 8 may be configured differently and/or the first and second hinges H1, H2, H3, 15 may be arranged not in a coaxial manner. The actuation portion 12*a* may be resiliently movable and act as a valve to reduce the size of the interior volume V and allow air to pass in through one or more vent holes 13*a*, 13*b*, 13*c* when pressure is applied to the actuation portion 12*a*. The vent holes 13*a*, 13*b*, 13*c* may be of a predetermined shaped because of the predetermined distal position taken by the actuation portion 12*a*, without modifying the shape of the peripheral part 14.

In this first embodiment, the vent holes 13*a*, 13*b*, 13*c* are provided adjacent to the peripheral part 14 and are enlarged toward the longitudinal axis X, as visible in FIG. 3B. The configuration of the outer surface 16 of the closing member 8 is well adapted to guide air toward the rib R2. Such rib R2 that extends longitudinally from the bearing member B is facing an associated vent hole ,13*a*, 13*b*, 13*c*. It thus may act as divider means for diverting the air flow entering toward the side wall 4 according to two divergent directions. Such arrangement is efficient to obtain correct insertion of air in the internal recesses HR along the side wall.

Figure 7:
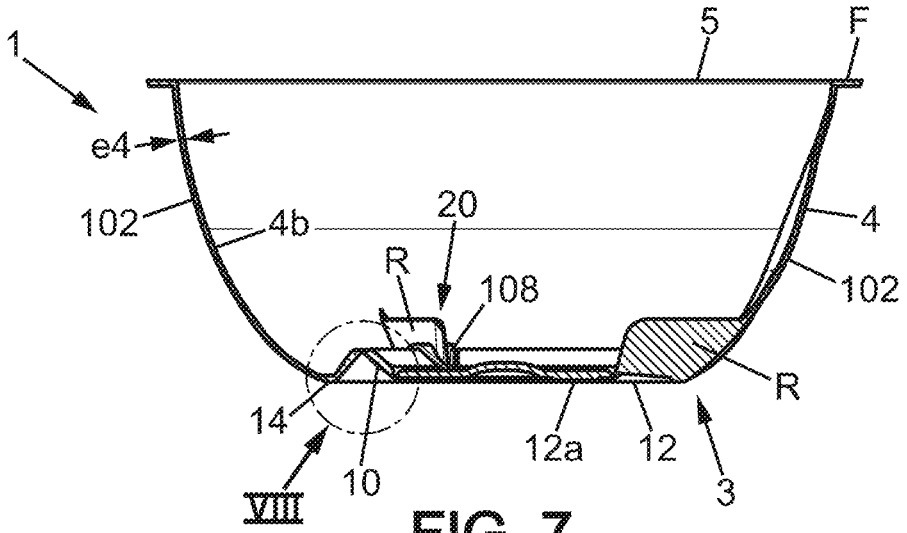
FIG. 7 is an axial cut view showing the container of FIG. 6.
Figure 8:
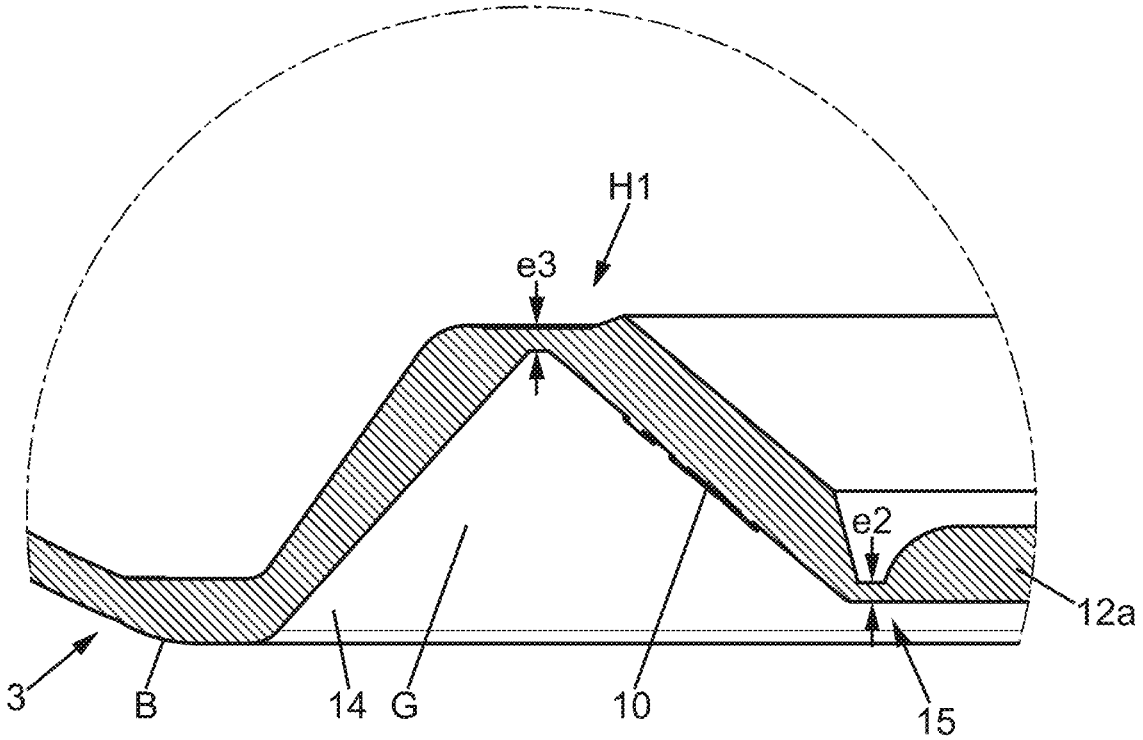
FIG. 8 shows a detail from FIG. 7.

A specific description of a second embodiment of the invention is now provided with reference to FIGS. 6-8.

The container 1 shown in FIG. 6 may be obtained as the container 1 shown in the preceding Figures, and the hollow body 102 may be a single piece of thermoplastic material provided with a similar venting device 20. The particularity of this second embodiment is due to the arrangement of the closing members 108, around the actuation portion 12*a* and separable from the actuation portion 12*a*. As shown in FIG. 6, each closing member 8 is fixed relative to the outer edge 3*a* and extend from the outer edge 3*a* to an end 108*a* that is preferably narrowed, for instance tapered. Here in this example, three closing members 108 are provided and are defined as tabs or tips protruding radially from the peripheral part 14 toward the longitudinal axis X or a central region of the bottom wall 3. The preferably tapered closing members 108, are arranged adjacent to the push member 12, at least in the initial proximal position. These closing members 108 define rigid protrusions (here protruding from the peripheral part 14) in the distal position of the push member 12. The dome D remains similar to what is shown in FIG. 3B but it is thus provided with such rigid protrusions on the exterior surface S. Indeed, with such configuration, a dome shape of the bottom wall 3 is also obtained in the distal position and the closing members 108 protrude (externally) around the central pushed area.

The closing members 108 remain as static as the peripheral part 14, not following movement of the actuation portion 12*a*. Such arrangement may be useful to prevent improper pushing action at a distance from the longitudinal axis X since the user feels more rigidity at the location of the closing members 108 and is thus incited to push at the centre of the actuation portion 12*a*.

It is understood that the longitudinal axis X intersects the actuation portion 12*a* and the vent holes 13*a*, 13*b*, 13*c* may be all laterally shifted with respect to the actuation portion 12*a*. Indeed, the push member 12 is arranged distal from the side wall 4, while the closing members 108 are located at a distance from the push member 12 in the predetermined distal position.

In the second embodiment, ribs R1 and R2 may be replaced by a common inner rib R protruding inwardly (toward the food content) from the closing member 108 and joining the side wall 4 over the inner face of the peripheral part 14 (across the internal recesses as the ribs R2). The bottom wall 3 is here provided with at least three closing members 108 extending from the peripheral part 14 to the end 108*a* that is adjacent to the push member 12. Such end 108*a* here corresponds to the junction with the outer rim 12*b* of the actuation portion 12*a*.

Of course, the functions of the ribs R are similar to the functions of the ribs R1, R2. The vent holes 13*a*, 13*b*, 13*c* are provided adjacent to the peripheral part 14 and thus may extend between the tow hinges H1, H2, H3, 15, as in the first embodiment.

In the first and second embodiments, the first hinge H1, H2, H3 defines the outer rim 12*b* and facilitates longitudinal movement of the actuation portion 12*a* without significant deformation of the pushed area (as shown in FIGS. 3A-3B, the actuation portion 12*a* may remain as flat in both positions of the push member 12). With such configuration, the thickness of the actuation portion 12*a* may be relatively low, without need for adding a more rigid layer. Referring to FIGS. 7-8, it can be seen that the intermediary wall parts 10 extend between two lines with lower thickness. The first hinge H1, H2, H3 may have a thickness e3 of about 0.3 mm and the thickness e2 of the second hinge 15 (here also a plastic hinge) may be about 0.3 mm. More generally, these thicknesses e2, e3 may be suitable for hinge effect, preferably superior to the thickness e of the frangible connections 7 and inferior to the thickness e4 of the side wall 4.

Referring to FIG. 3B and 6-8 in particular, the closing members 8, 108 each define a discontinuity in one of the first and second hinges of annular shape. Indeed, the closing members 8, 108 are typically not hinged. For instance, in the first illustrated embodiment, there is no reduction of thickness to obtain the thickness e2 in a position adjacent the closing members 8. Accordingly, the first hinge H1, H2, H3 is defined by three sections as visible in FIG. 3B. Similarly in the second illustrated embodiment, there is no reduction of thickness to obtain the thickness e3 in a position adjacent the closing members 8. The second hinge 15 is defined by three sections as visible in FIG. 6, with gaps corresponding to the closing members 108.

According to an option useful with several alternative embodiments for actuating the opening of the vent holes 13*a*, 13*b*, 13*c*, the actuation portion 12*a* has a maximal size (typically a diameter defined by a circular outer rim 12*b*), which is inferior to 30 or 35 mm. Such size, which remains superior to about 15 or 20 mm, is well adapted to define an efficient push button or push area and prevent incomplete break of all the frangible connections 7.

In other embodiments, the frangible connections 7 may correspond to local portions of non-annular ridges, for instance two ridges defined at two opposite sides of the intermediary wall parts 10. The bottom wall 3 can present a profile similar as shown in FIGS. 1 and 7-9, with two successive sloped parts, one of which defines the intermediary wall part 10 that is hingedly connected (via one of the ridges) to the actuation portion 12*a* of the push member 12. A predetermined position is obtained in the distal position since the intermediary wall parts 10 are not separated from the actuation portion 12*a*. Only portions of the ridges are broken to define vent holes 13*a*, 13*b*, 13*c* and air enters inside the container 1 through the bottom wall 3. A single frangible connection 7 may optionally be used in some variants, such frangible connection 7 preferably extending across an intermediary wall part 10.

Referring to FIGS. 4-5 and 7, a container 1 in accordance to the invention may be obtained by using two kinds of closing members 8, 108. For instance, at least one closing member 8 is distinct and separable from the peripheral part 14 (and rigidly connected to the actuation portion 12*a*, possibly with reinforcing means such as a rib R1) and at least one closing member 108 is distinct and separable from the actuation portion 12*a* (and rigidly connected to the peripheral part 14, possibly with reinforcing means such as a rib R). Advantageously, the discontinuity in the first hinge H1, H2, H3 may be reduced in such option, when comparing to the configuration of the first embodiment. For instance, three or four vent holes may be used and the thumb or other suitable finger to actuate the push may be orientated (following indicating elements displayed on the exterior surface S), in order to avoid finger contact with a closing member 108 that protrudes from the exterior surface S in the distal position.

A process of making a packaging that includes the container 1, a closing system and the food content is now described referring to FIGS. 4 and 9-11.

In one embodiment, a container 1 is provided, possibly by extracting a single container from a stack such as illustrated in FIG. 9. Alternatively, each container 1 may be part of a pack of containers connected by their flanges F. Preferably, the bottom wall 3 and the side wall 4 are parts of a single-piece hollow plastic body 2. Then a filling step is performed with a pouring through the opening 5, into the single compartment defined by the container 1. When several layers are used to define the food product, the layers are successively filed. When the food product consists in a mixture of at least two compositions, the filling of each container 1 may include one or more steps, possibly with more than one injection outlet when two or more compositions are mixed. It is understood that the bottom wall 3 is in direct contact with food product, in particular the composition that has been firstly received in the container 1.

Optionally when a firm part M, M' of the food product comprises milk, fermentation is allowed in the container 1. The milk is fermented by the lactic acid bacteria, typically to a final pH lower than setting pH. A set fermented dairy composition thus can be obtained, defining a firm part M, M' of the food product.

After the filling, and provided that the food product is in a molded state in the container 1, the food product is recovered. Alternatively when fermentation occurs, a sealing for recovering the food product can be performed before the firm part M of the food product is in a definitive set state. The container 1 is sealed, possibly by fixing a seal membrane 5*a* onto the upper face of a flange F or similar annular top of the container 1. A flexible film, possibly comprising one or more metallised layers, can form part of the seal membrane 5*a* which provides per se the lid function, without any additional rigid cover. Alternatively, a rigid cover may be used (either to cover the membrane seal 5*a*, or to directly seal the container 1). The cover may be for instance a hard plastic cover.

In a non-limiting manner, the containers 1 can be used for 50-500g capacity, preferably 75-200g capacity.

The containers 1 typically contain a product to be released from the container 1 upon actuation. This releasing operation is also referred to as unmolding. The product is typically an edible product, also referred to herein as "food content". The product has typically a volume of from 80% to 100% of the container capacity.

The food content released using the container 1 is now described with reference to FIGS. 10-11.

The product comprises at least one part that is firm M, M', and optionally another part that is not firm 30, 31, referred to as "non-firm". The firm product or part M, M' typically is in contact with the container 1, and has shape at least partly corresponding to the shape of the container 1. Herein a "firm" product or part M, M' refers to a solid or semi-solid product or part that would retain a shape after unmolding, after 5 minutes at room temperature, preferably 20° C., preferably with a shape corresponding to the shape of the container 1. In a preferred embodiment the firm part M, M' has between 20 to 60 g of texture (typically measured with a TaXT2 texture analyzer with the following settings: Speed before analysis: 0.5 mm/s; Speed during analysis: 1 mm/s;

Speed after analysis: 10 mm/s; Length: 4 mm; Time: 30 s; Strength mini: 0.5 g), at temperature of use or at 10° C.

The product might comprise at least one part that is not firm 30, 31. Herein a "not firm" or "non firm" product or part refers to fluid or semi-fluid product or part that would flow after 5 minutes at room temperature, preferably 20° C.

When another part (preferably a flowable part as above defined) distinct from the firm part M, M' is provided, the firm part M, M' is preferably present in an amount of 70 to 99% by weight approximately, preferably between 80 and 98%. The other part may thus be present in a proportion of 1 to 30% by weight.

Figure 11:
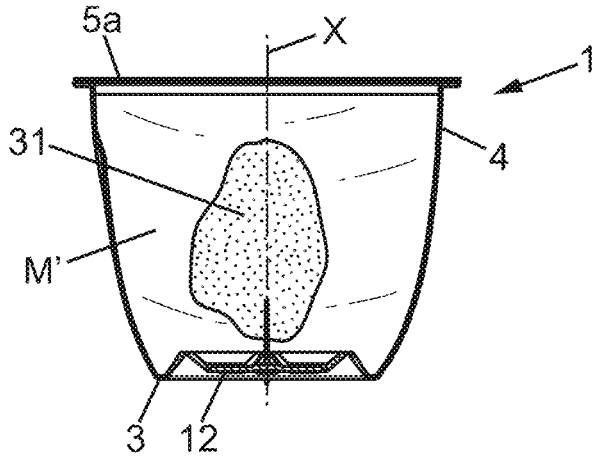
FIG. 11 is an axial cut view showing a firm part of the food content in contact with the container.

In one embodiment, as illustrated in FIG. 11, the product comprises a firm part M', with an inclusion of a non-firm part 31 in the firm part M'. In such an embodiment the non-firm part 31 is completely surrounded by the firm part M', and has no contact with the container 1.

In one embodiment the product comprises a firm part M and at least one not firm part that are arranged in layers. Preferably, the non-firm part (typically a topping 30) is in contact with the bottom wall 3 before the pushing and deformation of the actuation portion 12*a*. In other words, the non-firm part is a layer at the bottom of the container 1, that would form a top part upon unmolding (defining the topping 30 as illustrated in FIG. 10), while the firm part M is a layer above the bottom layer (which thus can be adjacent to the sealed opening 5), that would form a lower part M upon unmolding. As illustrated in FIG. 10, a support plate 34 or the like may be conventionally provided for contact with the wider part defined by the firm part M (lower part upon unmolding). In a preferred embodiment at least some of the top part will flow on the firm part M after unmolding. The firm layer can for example represent from 60 to 95% of the total volume of the product. The not firm layer can for example represent form 5% to 40% to the total volume of the product. Here, the firm part M is entirely covered by the topping 30 so as not to be in contact with the bottom wall 3 but options with partial covering may also be used.

The firm part M, M' can typically be a milk-based firm product, comprising milk or reconstituted milk and gelling agent. Examples of firm products M, M' include, custards, gelled yogurts, gelled cheeses, puddings, flans etc . . . Such examples are non limiting and, for instance, a firm part can be obtained using soy yogurt. It is understood that the firm part M, M' is not fragmented and, preferably, only one firm part M, M' is received in the container 1, especially when the food product is layered.

The non-firm part 30, 31 can be sauce, for example a chocolate, coffee or caramel sauce or a fruit preparation, for example a coulis or a jam. In a preferred embodiment the fruit preparation has a fluidity of 3 & 15 cm/min as a determined by cenco analysis, at temperature of use or at 10° C. In a preferred embodiment the non-firm part has a viscosity of from 1 to 1000 mPa·s, preferably from 1 to 500 mPa·s, at a shear rate of 64 $s^{-1}$ at temperature of use or at 10° C.

Figure 10:
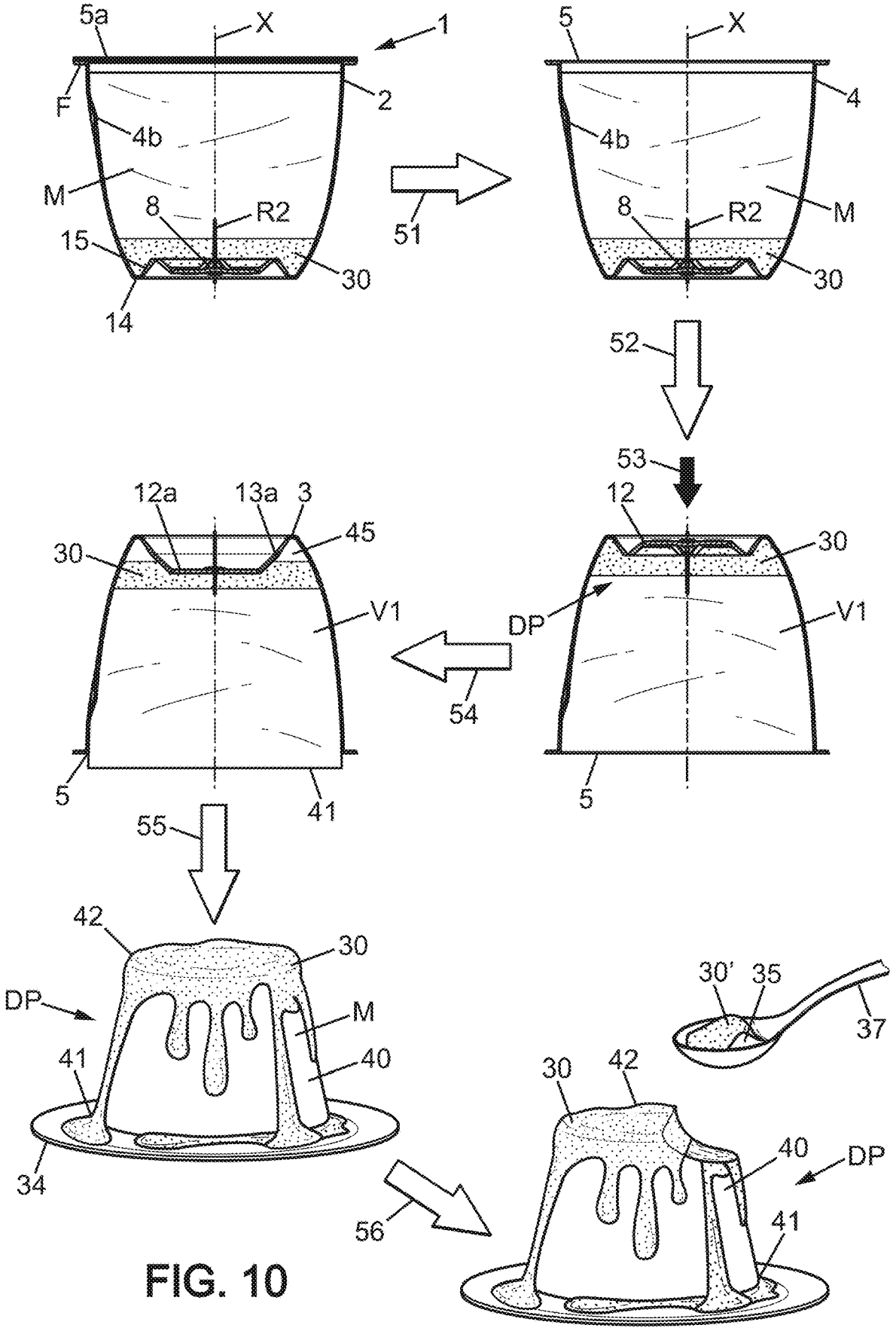
FIG. 10 is a diagram illustrating steps that may be carried out, in order to correctly release the food content.

Release of the food content is illustrated in FIG. 10. The release and usage of the open container 1 are typically performed at room temperature or at storage temperature. It can be seen that the container 1 is in a reverted position after two preliminary steps 51, 52 consisting, respectively, of removing the seal 5*a* and inverting the container 1 filled with the product. In this non-limiting example, the product comprises a not firm part to define a topping 30, in contact with the bottom wall 3. The firm part M extends between the topping 30 and the opening 5.

The push member 12 is then actuated in a pushing step 54, in which a substantially vertical pressure is exerted downwardly as indicated by the black arrow 53. The displacement of the actuation portion 12*a* causes a rupture of plastic material at the stationary adjacent parts that delimit the closing members 8. Since the closing members 8 have here the same kind of configuration with respect to the actuation portion 12*a* (as illustrated in FIGS. 3A-3B), the vent holes 13*a*, 13*b*, 13*c* are simultaneously created.

Referring to FIGS. 3*b* and 10, because of the dome D defined by the bottom wall 3 after such actuation, the food product may be provided with a longitudinal hollow or similar slight concavity (here with a depth not exceeding 6 or 9 mm to prevent undesirable fragmentation). After the release, the peripheral part 40 of the firm part M extends from a wider part 41 in contact with the support plate 34 to a narrow part 42. When the food product only contains a firm part M, such narrow part 42 (at the top) has a shape that may be conformed as the bottom wall 3 (indeed, the bottom wall 3 is the upper part in the inverted position of the container 1, as shown in FIG. 10). When a non-firm part is provided, it can be partly retained above the narrow part 42. This ensures that the narrow part 42 of the firm part M is axially covered by a sufficient amount of the non-firm part. The topping 30, which is optionally a flowable product, may at least partly cover a peripheral face 40 of the firm part M after the release from the container 1.

More generally, it is understood that the pushing step 54 is immediately followed by a substitution step 55, in which the molded food product received in the single compartment is replaced by air 45 entering through one or more vent holes 13*a*, 13*b*, 13*c*. With such substitution step 55, and because the push member 12 has been displaced longitudinally in a same direction/orientation as effect of gravity, the firm part M keeps its integrity and is discharged as one single block through the opening 5. Although the illustrated examples show a plurality of narrow vent holes 13*a*, 13*b*, 13*c*, the bottom wall 3 may alternatively be provided with a single hole or slit, so that air 45 enters inside the container 1. Increase of pressure in this part of the container 1 has an auxiliary push effect. After the pushing step 54, the molded food product is replaced by air 45 entering inside the container 1 without any additional user action. Preferably, air enters through at least two or three spaced vent holes 13*a*, 13*b*, 13*c* that extend between the first hinge H1, H2, H3 and the second hinge 15 (as shown in FIG. 3B). Accordingly with such option, air 45 firstly enters around a central area of the axial face of the molded food product.

It is understood that the volume V1 of the firm part M is substantially unchanged before and after the release (same molded shape). The firm part M has here a significantly greater volume V1 as compared to the volume of the non firm part. Referring to the example of FIG. 10, the topping 30 can flow along the peripheral face 40 without modifying the overall shape (as perceived by the user) of the food content.

It is advantageous to keep a part of the topping 30 (which may be flowable) at the upper end of the product received in the support plate 34. Typically, a user will start eating the food by extracting a first piece of product 35 (at step 56, using a spoon 37 or similar utensil) that belongs to the top of the firm part M. Such first piece of product 35 thus may comprise a part 30' of the topping 30 stored at the top. Then, the topping reservoir initially defined at the top is emptied by an additional downward sliding of the flowable compound or mixture used to define the topping 30.

Referring to FIG. 11, it can be seen that another kind of reservoir may be defined when the non firm part 31 is internally arranged in the firm part M'.

When the food content is a dairy product or other temperature sensitive edible product, the container 1 filled with the food content and sealed with a rigid cover and/or flexible seal membrane 5*a* is preferably stored in a cooled state. Storage at chilled 1-10° C. temperature is typically used. Alternatively for some compositions and/or depending on the intended use (fast consumption expected for instance), storage at room temperature is sufficient.

Of course, the containers 1 of the present invention are not in any way limited to custard products and yoghurt having a firm texture but can be intended to contain all sorts of solid and semi-solid products.

The present invention has been described in connection with the preferred embodiments. These embodiments, however, are merely for example and the invention is not restricted thereto. Although the Figures show a body 2, 102 having a circular cross-section and a circular opening 5, other shapes may be used, for instance a rectangular shape with rounded corners or an oval shape.

Regarding the bottom wall 3, the circular outer edge 3*a* may be replaced by an outer edge 3*a* with rectilinear sides, undulated sides or provided with an oval shape. The actuation portion 12*a* is not necessarily provided with a circular outer rim 12*b*. The hinges H1, H2, H3 may comprise two opposite hinges in some variants (not shown) using only one or two vent holes and the outer rim 12*b* can be provided with rectilinear sides defined by such opposite hinges. Other shapes may be used, depending on the configuration of the hinges H1, H2, H3 in the bottom wall 3. The vent holes 13*a*, 13*b*, 13*c* may vary in number and can be provided adjacent to corners or sides of the actuation portion 12*a*.

While, at least two spaced frangible connections 7, in particular three frangible connections 7, have been illustrated in the drawings to obtain the vent holes 13*a*, 13*b*, 13*c*, it is obvious that embodiments with any deformable means or ready to be pierced apertures may be used to form at least one vent hole 13*a*, 13*b*, 13*c*, provided that the opening is caused by displacement of the push member 12.

It will be understood by those skilled in the art that other variations and modifications can easily be made within the scope of the invention as defined by the appended claims, thus it is only intended that the present invention be limited by the following claims.

Any reference sign in the following claims should not be construed as limiting the claim. It will be obvious that the use of the verb "to comprise" and its conjugations does not exclude the presence of any other elements besides those defined in any claim. The word "a" or "an" preceding an element does not exclude the presence of a plurality of such elements.

The invention claimed is:

1. A package comprising a molded food product, comprising:

a container that is a single cup shaped piece, comprising a top, a bottom wall, and a side wall connected to the bottom wall, said side wall extending around a longitudinal axis of the container, so as to define an interior volume of the container also delimited by the bottom wall, the container having an opening opposite from the bottom wall, the opening being surrounded by the top; and the molded food product filling the interior volume;

wherein the bottom wall, comprises an outer edge extending around the longitudinal axis of the container, and a push member that is a venting device manually operable to define at least one vent hole in said bottom wall, wherein the push member comprises a single actuation portion, extending perpendicular to the longitudinal axis, at a distance from the outer edge, one or more closing members defined as rigid tabs or tips extending radially outward from the single actuation portion, each vent hole amongst the at least one vent hole being initially closed by a corresponding closing member of the one or more closing members, and at least one first hinge adjacent to the single actuation portion, wherein the push member is longitudinally movable between an initial proximal position, in which said at least one vent hole is closed, and a predetermined distal position, and wherein in the initial proximal position, the bottom wall comprises at least one second hinge at an annular junction between the outer edge and a peripheral part that is radially outward from the push member, and wherein the outer edge, the peripheral part and the push member define an annular groove, and the one or more closing members are within the annular groove and extend between the at least one first hinge and the at least one second hinge, wherein a longitudinal movement of the push member to the predetermined distal position, causing, simultaneously, a rupture of the one or more closing members which opens the at least one vent hole and a pushing of the molded food product toward the opening, and wherein in said predetermined distal position, said at least one vent hole extends, in the peripheral part around the single actuation portion, between the single actuation portion and the outer edge.

2. The package according to claim 1, wherein the opening surrounded by the top is a pour opening, and wherein the interior volume is undivided from the bottom wall to the pour opening and filled only with the molded food product as one block.

3. The package according to claim 1, wherein the at least one vent hole comprises two vent holes, wherein the one or more closing members comprise two closing members fixedly attached to the single actuation portion of the push member, and wherein the two closing members are rigid tabs or tips distributed in respective distinct angular sectors of the bottom wall.

4. The package according to claim 3, wherein two spaced frangible connections extend in the annular groove, wherein the push member is configured to break each of the two spaced frangible connections and form the two vent holes when the push member is displaced from the initial proximal position to the predetermined distal position, due to displacement of two closing members that remain fixedly attached to the actuation portion of the push member.

5. The package according to claim 1, wherein said at least one vent hole comprises two spaced vent holes each radially distant from the longitudinal axis.

6. The package according to claim 1, wherein the single actuation portion is configured as a flat push button in the bottom wall and in the predetermined distal position of the push member the bottom wall is dome-shaped toward the interior volume, and the single actuation portion being in direct contact with the molded food product, wherein in the predetermined distal position, the single actuation portion remains as flat as in the initial proximal position, and wherein in the predetermined distal position, said at least one vent hole is provided in a tapered annular wall part of the dome-shaped bottom wall.

7. The package according to claim 1, wherein the bottom wall and the side wall are parts of a single-piece hollow plastic body, the push member being integrally molded with the hollow plastic body, and in the predetermined distal position of the push member the bottom wall having a dome shape toward the interior volume.

8. The package according to claim 1, wherein in the predetermined distal position the at least one vent hole comprises a vent hole that extends between the at least one first hinge and the at least one second hinge and is delimited by a V-shape, in the predetermined distal position of the push member, and wherein the single actuation portion of the push member has a predetermined longitudinal stroke, with the single actuation portion being surrounded, in the predetermined distal position of the push member, by a tapered annular wall part extending between the at least one first hinge and the at least one second hinge.

9. The package according to claim 1, wherein in the predetermined distal position of the push member, the at least one vent hole comprising a plurality of vent holes that are spaced vent holes, each having a triangular shape.

10. The package according to claim 1, wherein the at least one vent hole comprises three vent holes, the one or more closing members comprising three closing members fixedly attached to the single actuation portion of the push member, and wherein the rigid tabs or tips comprise rigid protrusions that are distributed in three respective distinct angular sectors of the bottom wall.

11. The package according to claim 10, wherein the rigid protrusions comprise three triangular protrusions distributed around the single actuation portion.

12. A package comprising a molded food product, comprising:

a container that is a single cup-shaped piece, comprising a top, a bottom wall, and a side wall connected to the bottom wall, the side wall extending around a longitudinal axis of the container, so as to define an interior volume of the container also delimited by the bottom wall, the container having an opening opposite from the bottom wall, the opening being surrounded by the top; and a molded food product filling the interior volume;

wherein the bottom wall comprises an outer edge extending around the longitudinal axis of the container, one or more closing members, each of the one or more closing members defining a rigid protrusion and a push member that is a venting device manually operable to define at least one vent hole in said bottom wall, wherein the push member comprises a single actuation portion, extending perpendicular to the longitudinal axis, at a distance from the outer edge, and at least one first hinge adjacent to the single actuation portion, wherein the one or more closing members are fixed relative to the outer edge and extend radially from the outer edge to an end adjacent to the actuation portion of the push member, the one or more closing members being arranged around the actuation portion and being separable from the actuation portion, wherein the push member is longitudinally movable between an initial proximal position, in which said at least one vent hole is closed, and a predetermined distal position, wherein a longitudinal movement of the push member to the predetermined distal position, causes, simultaneously, a rupture of the one or more closing members which opens the at least one vent hole and a pushing of the molded food product toward the opening, and wherein in said predetermined distal position, said at least one vent hole extends, in a peripheral part around the single actuation portion, between the single actuation portion and the outer edge, and each vent hole amongst the at least one vent hole being closed by a corresponding closing member of the one or more closing members, and wherein in said initial proximal position, the bottom wall comprises at least one second hinge at an annular junction between the outer edge and a peripheral part that is radially outward from the push member, and the outer edge, the peripheral part and the push member define an annular groove, and the one or more closing members are within the annular groove and extend between the at least one first hinge and the at least one second hinge.

13. The package according to claim 12, wherein the single actuation portion is configured as a flat push button in the bottom wall and in the predetermined distal position of the push member the bottom wall is dome-shaped and the single actuation portion being in direct contact with the molded food product, wherein in the predetermined distal position, the single actuation portion remains as flat as in the initial proximal position, and wherein in the predetermined distal position, said at least one vent hole is provided in a tapered annular wall between the at least one first hinge and the at least one second hinge.

14. The package according to claim 13, wherein the at least one vent hole comprises two vent holes and, wherein, in the predetermined distal position, the two open vent holes each have a radial extension.

15. The package according to claim 12, wherein the at least one vent hole comprises vent holes, the one or more closing members comprising closing members fixedly attached to the peripheral part that extends around the push member, and wherein each of the rigid protrusions, defined by the one or more closing members, protrude radially inward from an annular inner edge of the peripheral part, in the predetermined distal position, the rigid protrusions being distributed in respective distinct angular sectors of the bottom wall.

16. The package according to claim 12, wherein the at least one vent hole comprises a plurality of spaced vent holes, each having a triangular shape.

17. The package according to claim 12, wherein the at least one vent hole comprises vent holes, the one or more closing members comprising closing members fixedly attached to the peripheral part that extends around the push member, the peripheral part comprising the outer edge, wherein the outer edge extends at a free end of the container and around the annular groove and wherein the rigid protrusions, distributed in respective distinct angular sectors of the bottom wall, protrude radially inward toward the longitudinal axis in the predetermined distal position.

18. The package according to claim 17, wherein the at least one vent hole comprises two vent holes, the one or more closing members comprise two closing members, the two closing members each defining two spaced frangible connections, and the two vent holes are initially closed by the two closing members in the initial proximal position, wherein the push member is configured to break each of the two spaced frangible connections and form the two vent holes when the push member is displaced from the initial proximal position to the predetermined distal position.

* * * * *